United States Patent [19]

McClean et al.

[11] 4,188,545

[45] Feb. 12, 1980

[54] YARN PROCESSING, METHOD AND APPARATUS

[75] Inventors: Arthur J. McClean, Harrogate, England; Kenneth F. Montgomery, Carrickfergus, Ireland

[73] Assignee: Imperial Chemical Industries Limited, Great Britain

[21] Appl. No.: 933,206

[22] Filed: Aug. 14, 1978

Related U.S. Application Data

[63] Continuation of Ser. No. 701,046, Jun. 29, 1976, abandoned.

[30] Foreign Application Priority Data

Jun. 30, 1975 [GB] United Kingdom ..... 27544/75

[51] Int. Cl.[2] ..... G01N 21/30

[52] U.S. Cl. ..... 250/561; 139/273 A

[58] Field of Search ..... 139/273 A; 250/209, 250/234, 561, 563; 356/199; 57/81; 66/161; 28/187; 19/21

[56] References Cited

U.S. PATENT DOCUMENTS

| | | | |
|---|---|---|---|
| 3,631,901 | 1/1972 | Langenbach et al. | 250/563 |
| 3,777,168 | 12/1973 | Sansone | 250/561 |

*Primary Examiner*—David C. Nelms

*Attorney, Agent, or Firm*—Herbert M. Adrian, Jr.

[57] ABSTRACT

The present invention relates in general to yarn processing and in particular to a method and apparatus for detecting unwanted yarn wraps on rotating rolls and consequently severing the supply yarn to prevent further wraps being wound.

8 Claims, 3 Drawing Figures

YARN PROCESSING, METHOD AND APPARATUS

Figure 1:
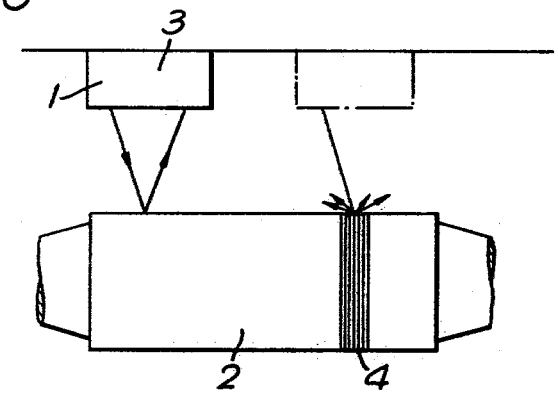

This is a continuation of application Ser. No. 701,046, filed June 29, 1976, now abandoned.

The detection of unwanted yarn wraps on rotating rolls in, for example, yarn winding machines, and action consequent thereon has long been a matter that has been dealt with solely by the machine operative. Yarn wraps have been detected visually by the operative who has then manually both severed the yarn being wrapped at some point upstream of the rolls and removed the wraps from the rotating rolls before "restringing" the machine. Until now this procedure has generally been found quite satisfactory due mainly to the relatively low yarn winding speeds that have been employed, but with increasing winding speeds a considerable amount of yarn may now be wasted before remedial action can be taken by an operative, who is then faced with the somewhat hazardous task of removing a substantial number of wraps from rolls rotating at high speed.

The present invention seeks to overcome these difficulties by providing a method for detecting the presence of yarn wraps on the peripheral surface of a rotating roll and consequently severing the yarn being wrapped at a point upstream of the roll comprising directing light from a source thereof towards the surface of the roll, detecting by photosensitive means any change in the intensity of light which returns from the roll in the absence of a wrap arising from the presence of such a wrap and converting any such change into an electrical signal to activate yarn severing means to severe the yarn.

The present invention also provides apparatus for carrying out the above method comprising a light source and means for directing light therefrom towards the surface of the roll, photosensitive detecting means arranged to detect changes in the intensity of light which returns from the roll in the absence of a wrap arising from the presence of such a wrap and means for converting any such change into an electrical signal to activate yarn severing means to severe the yarn being wrapped.

In one embodiment of the present invention light reflected from the peripheral surface of the roll in the absence of yarn wraps may be continuously received by the detecting means at substantially constant intensity until yarn wraps occur on that part of the roll periphery from which the light is reflected. In such a case the presence of the yarn wraps causes the incident light to be randomly scattered or absorbed so that a considerably reduced amount of light is then received by the detecting means, resulting in such a change (decrease) in intensity of received reflected light that a sufficient electrical signal may be generated to activate the yarn severing means.

In a second embodiment light reflected from the peripheral surface of the roll in the absence of yarn wraps is in such a direction with respect to the detecting means that substantially no light is received thereby. Instead light is only received by the detecting means when yarn wraps occur on that part of the roll periphery from which the light is reflected and the light is randomly scattered thereby. As in the embodiment described above this results in such a change (increase) in intensity of received reflected light that a sufficient electrical signal may be generated to activate the yarn severing means.

After yarn wraps have been detected and the yarn severed, e.g. by knife edge, guillotine or scissors, to prevent further material being wrapped, the severed end of the supply yarn may be held, for example, by a suction gun or catch tray to prevent it from refouling moving machinery parts. The severed end of the wrapped yarn, on the other hand, is usually held sufficiently closely to the rotating roll that there is no need to make separate provision to prevent the end from catching in other moving parts.

In order to maximise the change in the intensity of light reflected from the roll when yarn wraps are present, the peripheral surface of the roll or at least that part of the surface from which incident light is to be reflected should preferably be highly polished or chromium plated and the yarn sufficiently delustred to scatter rather than reflect the incident light.

Figure 2:
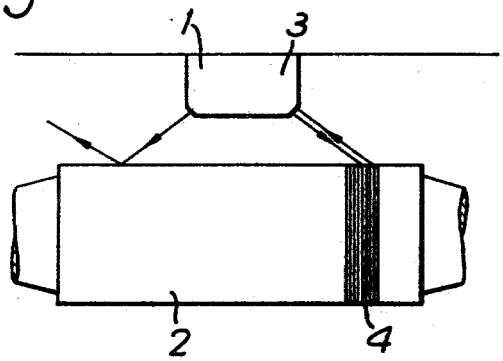
Figure 3:
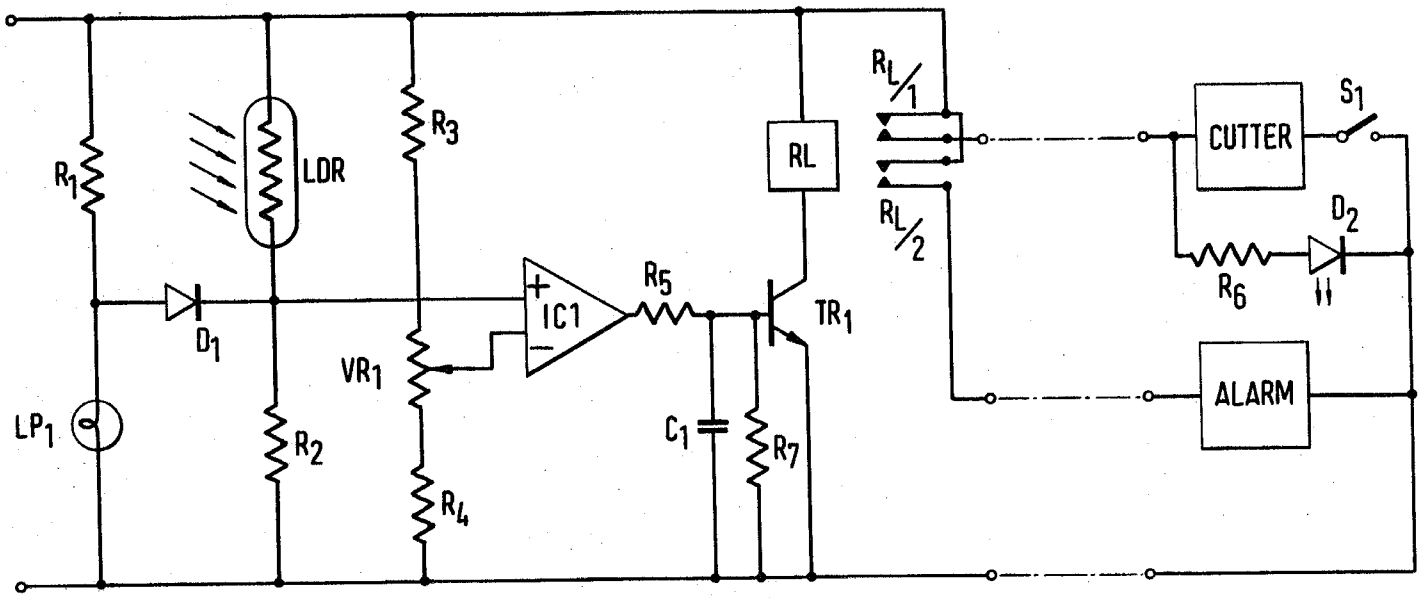

Examples of the two embodiments described above are illustrated by the detector arrangements shown in accompanying FIGS. 1 and 2 in which:

FIG. 1 is an arrangement in which light reflected from the peripheral surface of the roll in the absence of yarn wraps is continuously received by the detecting means, FIG. 2 is a similar arrangement but one in which light reflected from the surface of the roll in the absence of yarn wraps is not received by the detecting means, and FIG. 3 is an electrical circuit employed with the arrangement of FIG. 2.

Referring to FIG. 1, light from a prefocus source thereof 1 is directed towards the peripheral surface of a rotating cylindrical roll 2 and in the absence of yarn wraps on the surface of the roll is reflected therefrom to photosensitive means 3. On the formation of yarn wraps 4 on the surface of the roll incident light is no longer geometrically reflected from the roll surface but instead is randomly scattered or dispersed as indicated. Thus the failure of the roll to reflect the same intensity of light as it did in the absence of yarn wraps is used to generate an electrical signal which in turn is used to activate yarn severing means located upstream of the offending wraps.

In FIG. 2 a similar arrangement is shown except in this instance incident light from a prefocus source thereof 1 is reflected away from the photosensitive detector means 3 in the absence of yarn wraps, while light scattered by the presence of wraps 4 is detected and employed to generate the electrical signal required to activate the yarn severing means.

For both the embodiments described above a photoelectric method may be used to detect the wraps and operate a relay which in turn activates the yarn severing means. In addition a warning light or alarm may also be activated by this method.

Of the embodiments shown in FIGS. 1 and 2, the arrangement shown and described in FIG. 2 is preferred and FIG. 3 depicts a suitable electrical circuit for the operation of that embodiment. The circuit also includes means for activating a master alarm, a yarn severing means and a warning light which also lights if the light source fails.

Referring to FIG. 3, a potentiometer chain $R_3$, $VR_1$, $R_4$ is used to provide a variable threshold voltage which is applied to the inverting input of an operational amplifier $IC_1$. A second potential divider is formed by a light dependent resistor LDR and $R_2$. The voltage at the junction of the resistor LDR and $R_2$ will of course vary with the amount of light falling on the resistor. A third potential divider is formed by $R_1$ and lamp $LP_1$ and the voltage at the junction will normally be the running voltage for the lamp. In the event of lamp failure, this junction voltage will rise and the voltage will be transmitted via diode $D_1$ to the junction of the resistor LDR and $R_2$.

The action of the circuit is such that the amplifier is used as a comparator and its output is normally low. When the lamp fails or light falls on the resistor LDR, the non inverting input, assuming the threshold level set by $VR_1$ is correct, goes positive with respect to the threshold level, the output of the amplifier also goes positive which turns on transistor $TR_1$ via potentiometer chain $R_5$, $R_7$; this then energises the relay $R_L$ which in turn switches on the yarn cutter and warning lamp (light emitting diode $D_2$) via $R_L/1$ and master alarm via $R_L/2$. A switch $S_1$ is provided to isolate the cutter.

The setting of the threshold level is achieved by the potentiometer $VR_1$ and is set so that in the illuminated condition the output of the amplifier is high.

The circuit includes a capacitor $C_1$ which in conjunction with resistor $R_5$ provides a time delay in the cutter actuating and alarm relay $R_L$. This reduces the likelihood of spurious operation of the cutter due to the passage of fly through the optical path.

Typically the following components may be employed in the operation of the above circuit:

| | | | |
|---|---|---|---|
| $R_1$ | 22 ohms | $C_1$ | 22μF |
| $R_2$ | 5.6K | $D_1$ | type 1 B30 |
| $R_3$ | 1.5K | $D_2$ | L.E.D.4 - (RS Components Ltd, London, England) |
| $R_4$ | 1.5K | $IC_1$ | type 741 |
| $R_5$ | 15K | LDR | type O.R.P.12 |
| $R_6$ | 2.2K | $LP_1$ | 2.2v, 0.25A prefocus |
| $R_7$ | 4.7K | $R_L$ | Min.P.C. 6v 410 ohm |
| $VR_1$ | 25K | $TR_1$ | type 2N1711 |

If it is necessary or desirable to remove the electronic circuitry from the immediate vicinity of the yarn processing apparatus then a flexible fibre optic probe can be used. In which case the same fibre optic bundle may be used to transmit both the incident and reflected light.

Also, the invention is not limited to the use of visible light, for example, an infra-red emitter may be used in place of the prefocus lamp.

Depending upon the length of the rotating roll over which yarn wraps are likely to occur and whether such wraps will quickly spread out along the roll length, it may be necessary to employ two or more detector arrangements which will then detect relatively narrow wraps on any part of the peripheral surface of the roll. Alternatively, a single arrangement may be caused to traverse backwards and forwards along the length of the roll.

The present invention is particularly valuable in yarn winding processes where winding speeds exceed 2000 meters/minute and possibly even 4000 meters/minute. In such processes where yarn is wound onto a bobbin which is surface driven by contiguous drive rolls, the need to detect the presence of yarn wraps on the rolls before they have had time to build up is particularly important if the wraps are, subsequently, to be removed manually from the rotating rolls without creating a potential hazard for the operator.

In the practise of the invention an improvement is sensitivity to the presence of yarn wraps of at least 10–100 X when compared with existing detecting methods/apparatus has been found.

What we claim is:

1. A method for detecting the presence of yarn wraps on the peripheral surface of a rotating roll and consequently severing the yarn being wrapped at a point upstream of the roll wherein the improvement comprises continuously directing light from a source thereof towards the moving peripheral surface of the roll, continuously monitoring by photosensitive means, reflecting light from said moving surface, detecting any change in the intensity of light which returns from the roll in the absence of a yarn wrap and that arising from the presence of such a wrap, said light being directed such that substantially no light is received by the detecting means in the absence of a yarn wrap, and converting such change into an electrical signal to activate yarn severing means to severe said yarn at a point prior to reaching said roll.

2. A method according to claim 1 in which the electrical signal activating said yarn severing means additionally activates a warning signal.

3. A method according to claim 1 in which visible light is employed.

4. An apparatus for detecting yarn wraps on a rotating roll and subsequently severing detected wraps, the improvement comprising a light source and means for continuously directing light therefrom towards the peripheral surface of a rotating roll, photosensitive detecting means positioned to continuously monitor the intensity of light reflected from said rotating roll, directing said light in a direction to minimize reflected light to the detector in the absence of yarn wraps, said photosensitive detecting means having electrical signaling means responsive to light intensity and being electrically connected to yarn severing means, wherein said photosensitive means electrically signals and actuates said yarn severing means responsive to changes in light intensity reflected from said rotating roll.

5. The apparatus according to claim 4 in which the surface of the roll is chromium plated.

6. The apparatus according to claim 4 in which the yarn is severed by a knife edge.

7. The apparatus according to claim 4 in which a flexible fibre optic probe is employed to transmit the light.

8. The apparatus according to claim 4 in which the detecting means is caused to traverse backwards and forwards along the length of the rotating roll.

* * * * *